United States Patent [19]

Simmonds

[11] Patent Number: 5,030,030

[45] Date of Patent: Jul. 9, 1991

[54] PAD FOR SUPPORTING A UTILITY ACCESS CONDUIT AND METHOD FOR INSTALLING SAME

[75] Inventor: Larry V. Simmonds, Medford, Oreg.

[73] Assignee: Riedel Omni Products, Inc., Portland, Oreg.

[21] Appl. No.: 498,110

[22] Filed: Mar. 23, 1990

Related U.S. Application Data

[63] Continuation of Ser. No. 171,822, Mar. 22, 1988, Pat. No. 4,925,336.

[51] Int. Cl.[5] ..... E02D 29/14

[52] U.S. Cl. ..... 404/25; 404/26

[58] Field of Search ..... 404/25, 26, 32, 33, 404/35, 72, 75, 77, 82; 52/19, 20; 264/31, 35, 261, 263; 156/71, 294

[56] References Cited

U.S. PATENT DOCUMENTS

| | | | |
|---|---|---|---|
| 132,682 | 10/1872 | Morang | 404/73 |
| 957,387 | 5/1910 | Stedman | 404/32 X |
| 1,280,363 | 10/1918 | Anderson | 404/32 |
| 1,585,111 | 5/1926 | Reichert | 404/32 X |
| 3,263,580 | 8/1966 | MacMillan | 404/25 |
| 3,915,582 | 10/1975 | Clarke | 404/75 |
| 4,365,743 | 12/1982 | Trickel et al. | 404/34 X |
| 4,623,170 | 11/1986 | Cornwall | 264/31 X |
| 4,748,787 | 6/1988 | Harbeke | 52/221 X |
| 4,759,656 | 7/1988 | Wilson | 404/26 |
| 4,808,025 | 2/1989 | McGinnis | 404/26 |
| 4,925,336 | 5/1990 | Simmonds | 404/72 X |

*Primary Examiner*—Ramon S. Britts
*Assistant Examiner*—Gay Spahn
*Attorney, Agent, or Firm*—Chernoff, Vilhauer, McClung & Stenzel

[57] ABSTRACT

The present invention relates to a pad which supports a utility access conduit in a roadway and permits relative movement between the conduit and the roadway without damaging the seal between them and which supports vehicular traffic for a time comparable to the life of the roadway itself, without the occurrence of any dipping in the vicinity of the access conduit. This is accomplished with a rectangular block or rubber or similar compressibly resilient elastomeric material which has an opening passing through it that snugly engages the access conduit. The invention also relates to a method for installing the pad in either a new or existing roadway.

6 Claims, 3 Drawing Sheets

FIG. 1
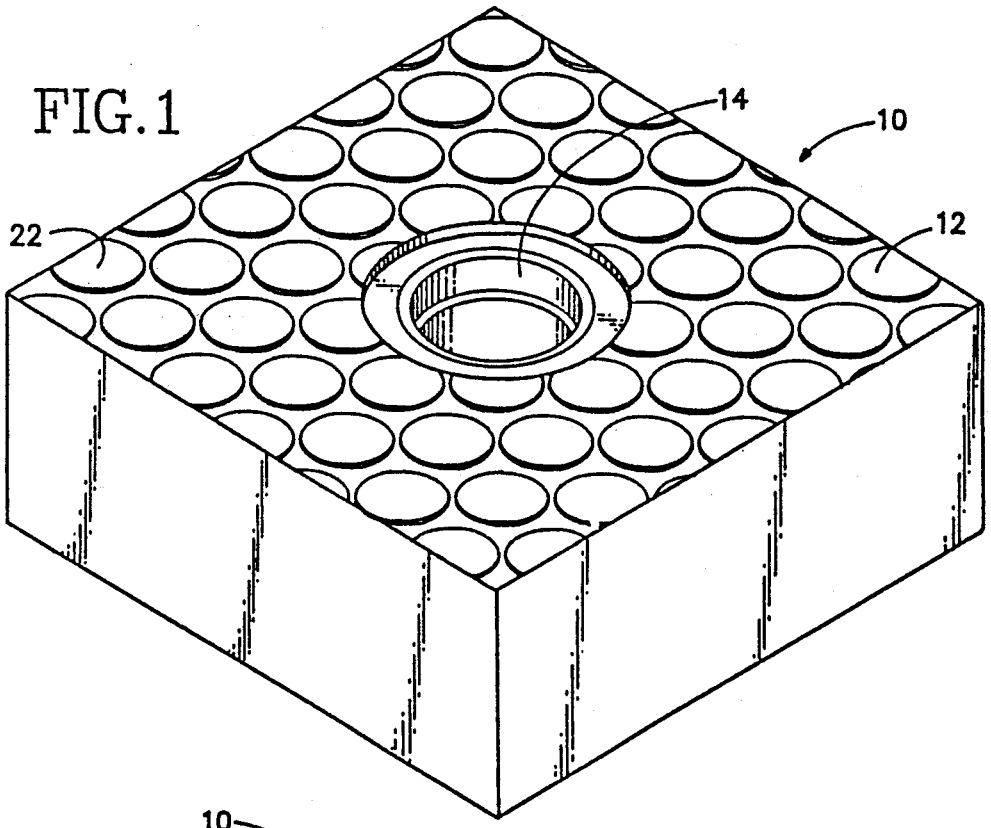
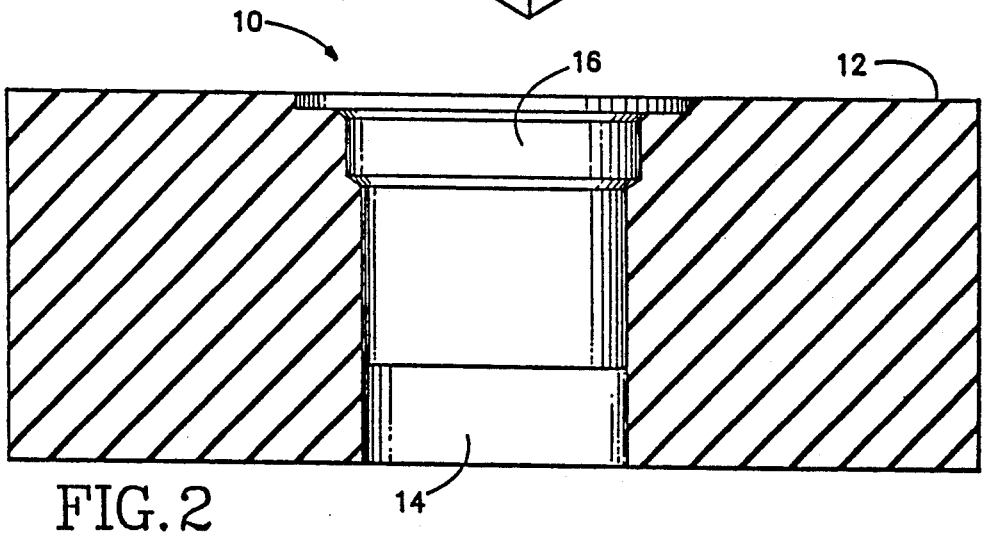
FIG. 2
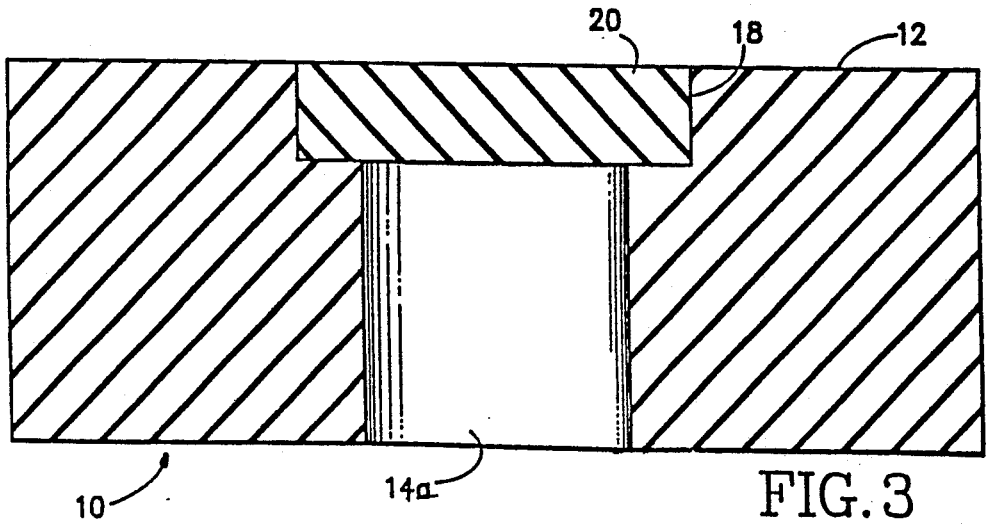
FIG. 3

PAD FOR SUPPORTING A UTILITY ACCESS CONDUIT AND METHOD FOR INSTALLING SAME

This application is a continuation of copending patent application Ser. No. 07/171,822, filed Mar. 22, 1988.

BACKGROUND AND SUMMARY OF THE INVENTION

This invention relates to a pad which is used to support a utility access conduit in a roadway and to a method for installing such a pad in both new and existing roadways.

There are numerous situations where it is necessary to obtain access to a below-ground utility device. Such access could be to permit a person to enter a pipe, such as with a manhole, to permit a person to actuate a valve, such as with a valve box, or merely to observe a meter or survey monument, such as with a meter box. These situations require that an access conduit be placed in the ground to prevent the device being accessed from becoming covered. In addition, where vehicular or foot traffic will travel over the access conduit, the conduit must be in two telescoping pieces, one which is attached to the object being accessed and the other being supported by the surface. This allows the two pieces to move relative to one another to accommodate movement of the ground due to traffic. A problem with access conduits of this type is that the piece which is supported by the surface will start to move relative to the surface and the bond between them will be broken. This results in degradation of the surface adjacent to the access conduit and displacement of the conduit so that its upper extremity is either above or below the surface, where it will be an impedement to traffic.

A good example of this situation is in the case of a valve box which is installed in an asphalt roadway. When asphalt roads are constructed they are compacted by large rollers to bind the asphalt together. However, these rollers cannot come right up to the edge of a valve box without the risk of striking it and causing it to be damaged. Thus, the asphalt immediately adjacent to the valve box is compacted by hand or by a smaller roller and, as a result, is not as compacted as the asphalt in the rest of the roadway. Traffic on the roadway causes the area around the valve box to further compact which creates a dip in the roadway surface. In addition, since cured asphalt is quite rigid when cold and pliable when hot, traffic striking the valve box causes it to move relative to the roadway, which in time creates a gap between them. Water then enters the gap and freezes, which causes cracking of the roadway adjacent to the valve box. Furthermore, the combination of the valve box being separated from the roadway and the roadway settling can cause the valve box to protrude from the roadway which creates a serious hazard to traffic.

The present invention overcomes the foregoing problems by providing a rectangular block made from rubber or an elastomeric material which is both compressible and resilient which acts as a pad for supporting the access conduit. The pad has an opening through its center which snugly supports the desired utility access conduit. Thus, when the pad is inserted into a roadway surface it provides a relatively large traffic supporting surface which, due to its resiliency, will remain flush with the roadway surface. In addition, due to its compressibility, the pad will move with the access conduit when it is driven over and the access conduit will not become separated from the pad but will continue to be snugly supported by it. As a result, the dip which occurs adjacent to an access conduit in the prior art installations will not occur and water will not be able to seep around the edges of the access conduit where it can cause damage if it becomes frozen.

The pad is embedded into a roadway by first removing a portion of the pavement to make a rectangular hole which is slightly longer and wider than the block and is several inches deeper than the height of the block. The sub-base at the bottom of the hole is leveled and compacted and the hole is partially filled with a settable compound, such as wet concrete mix, so that the distance from the top of the settable compound to the road surface is slightly less than the height of the block. The block, with the access conduit in it, is then placed into the hole and tamped until its top is level with the roadway surface. This will force some of the settable compound into the gap between the block and sides of the hole. The rest of the gap, except for the top one to two inches, is filled with additional set table compound. After the settable compound has cured, the remainder of the gap is filled with a rubber-like sealant.

Accordingly, it is a principal object of the present invention to maintain traffic safety by providing a pad for supporting a utility access conduit in a roadway which will prevent separation of the conduit and the pad and will prevent settling of the roadway surface around the access conduit. It is a further object of the present invention to provide such a pad which can be installed in either a new or existing roadway.

It is a further object of the present invention to provide a method for installing such a pad in an existing roadway.

The foregoing and other objectives, features and advantages of the present invention will be more readily understood upon consideration of the following detailed description of the invention taken in conjunction with the accompanying drawings.

BRIEF DESCRIPTION OF THE DRAWINGS

FIG. 1 is a perspective view of a utility access conduit support pad embodying the features of the present invention.

FIG. 2 is a sectional view of the pad of FIG. 1.

FIG. 3 is a sectional view of another embodiment of the pad.

PREFERRED EMBODIMENT OF THE INVENTION

Figure 4:
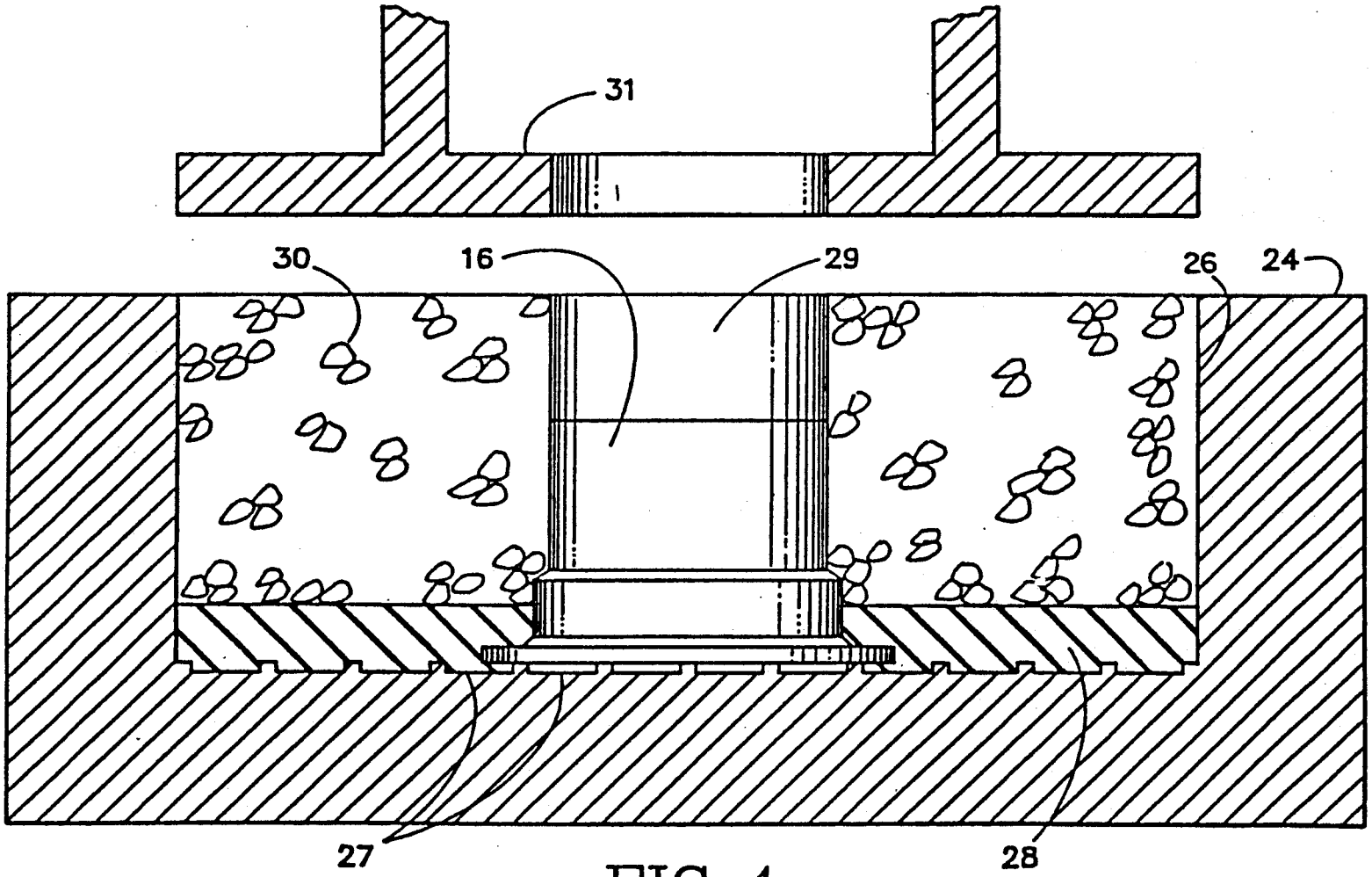
FIG. 4 is a sectional view showing the method by which the pad is made.

Referring to FIGS. 1 and 2, the pad 10 of the present invention includes a block 12 of rubber or an elastomeric material which is slightly compressible and extremely resilient. In the embodiment illustrated the block is rectangular but it could have other shapes as well. The block must, however, be considerably larger than the utility access conduit it will support. Extending through the center of the block 12 is an opening 14 which will snugly receive a particular utility access conduit 16, which in the embodiment illustrated is a valve box.

In an alternate embodiment of the invention, the opening 14a is not made to receive a utility access conduit but is merely a straight cylindrical passageway. In this embodiment the top portion of the opening comprises a counterbore 18 which is larger than the opening 14a in order to receive a plug 20. The plug 20 preferably is made from the same material as the block 12 and it fits tightly into the counterbore 1 in order to prevent water from leaking into the opening. The plug has recesses (not shown) formed in its upper surface which are arranged to receive a tool which facilitates removal of the plug from the block. In both embodiments, the block has a tread formed in its upper face to create a non-skid surface. In the embodiment illustrated the tread comprises rows and columns of cylindrical protrusions 22.

Referring to FIG. 4, in a preferred embodiment of the invention, the block is formed in a mold 24 having a rectangular open-topped cavity 26 which is the same shape as the block which will be formed in it. Voids 27, corresponding to the protrusions 22, are located in the bottom of the cavity 26. A thin mat of virgin rubber 28, having the same shape as the cavity, is placed in the bottom of the cavity. A hole must be cut in the center of the mat before it is placed in the cavity in order to allow the access conduit 16 or the plug 20 to fit into it.

Figure 5:
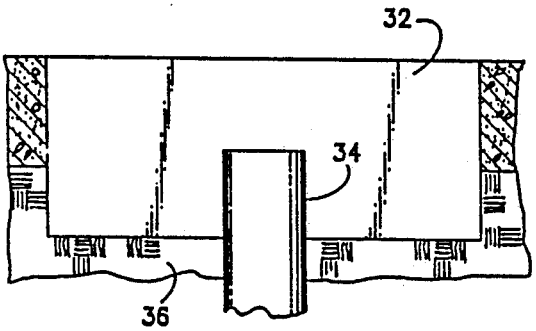
FIGS. 5–10 are sectional side elevation views showing the sequence of installation of the pad in an existing roadway.

In the embodiment of the pad which carries the access conduit, the conduit 28, along with an extension 29 which extends to the top of the cavity, is inserted into the mat. The cavity then is filled with comminuted particles 30 of rubber or a similar heat-fusible elastomeric material and appropriate curing additives. Ideal sources of such particles are rubber buffings which are a by-product of the tire recapping industry or shredded waste rubber products such as tires. A ram 30 forces a platen 31 into the cavity to place pressure on the particles and the mold is placed into a hot oven (not shown). When subjected to the application of pressure at a high temperature the particles bond together and to the mat 28 to form a solid pad which has an opening in it that snugly receives the access conduit. The process by which comminuted particles are bonded into a unitary block is described in detail in Trichel et al., U.S. Pat. No. 4,365,743. The pad 10 of the present invention can be used in new road construction or to repair existing roads. Referring now to FIG. 5, a rectangular hole 32 is first cut in the roadway. The hole 32 has a slightly larger length and width than the pad which will be inserted into it and will be centered on the riser 34. In addition, the hole will be considerably deeper than the height of the pad. After the hole 32 has been formed, the sub-base 36 is compacted to provide a level base.

Figure 6:
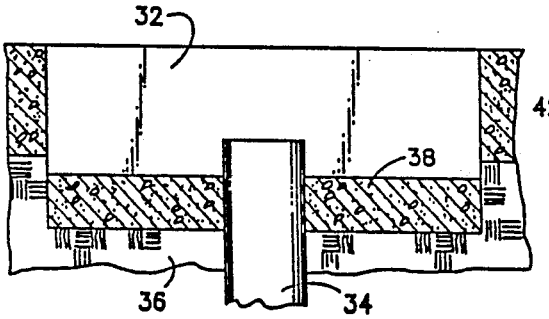
Figure 7:
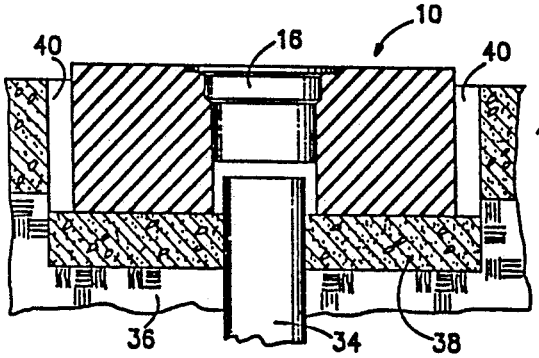

A layer of a settable compound 38, such as wet concrete mix, is then poured over the base, as shown in FIG. 6. The distance from the top of the settable compound to the roadway surface should be slightly less than the thickness of the pad. The pad, with the valve body 16 located in it, then is inserted into the hole 32 on top of the settable compound. The top of the pad will be above the level of the roadway and the valve body 10 will fit over the riser 34, FIG. 7.

Figure 8:
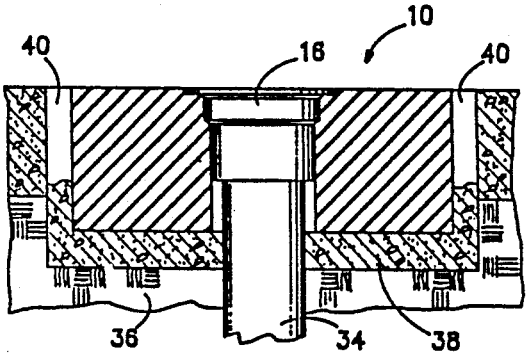
Figure 9:
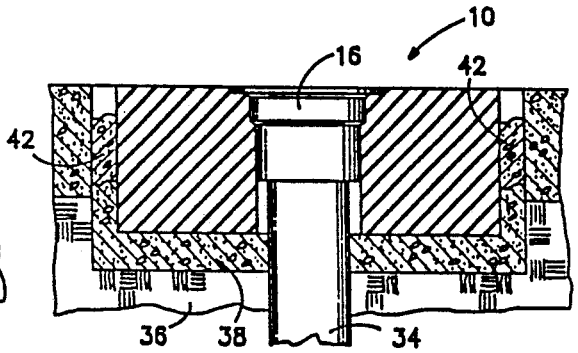
Figure 10:
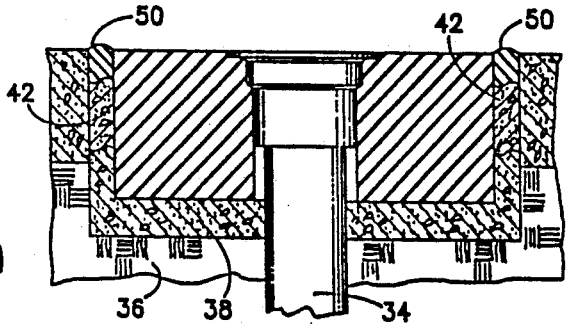

The pad then is tamped to settle the settable compound and align the top of the pad with the roadway. In order to ensure that the settable compound contacts the entire bottom of the pad extra settable compound is placed into the hole and this surplus partially fills the gap 40 which is formed between the sides of the pad and the sides of the hole, FIG. 8. Additional settable compound 42 then is placed into the gap to fill it almost to the surface of the roadway, FIG. 9. The remainder of the gap then is filled with a flexible waterproof sealant 50 to finish the installation, FIG. 10.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A pad for placement in a roadway to provide an access opening to a utility device below the roadway and to replace a portion of the roadway surface around the access opening, said pad comprising:

(a) a block made from rubber or similar elastomeric material;

(b) said block including planar upper surface means for replacing a portion of said roadway adjacent to the access opening and supporting vehicular traffic thereon;

(c) said block having an opening defined therein, said opening extending completely through said block perpendicular to said upper surface means and being located centrally in said upper surface means;

(d) said block having a counterbore defined therein coaxially with said opening, adjacent to said upper surface means; and (e) a plug having a planar top made from rubber or similar elastomeric material, said plug completely filling said counterbore when inserted therein with said planar top of said plug being coplanar with said upper surface means of said block.

2. The pad of claim 1 wherein the combined area of said upper surface means of said block and said top of said plug is at least four times the area of said top of said plug.

3. The pad of claim 1 wherein the shortest distance between the periphery of said counterbore and the periphery of said upper surface is equal to at least of the shortest dimension of said top of said plug.

4. The pad of claim 1 wherein said pad has a depth perpendicular to said upper surface means, said depth being equal to at least one-third of the shortest dimension of said upper surface means.

5. A utility device access opening in a roadway comprising:

(a) a roadway having an upper surface for supporting vehicular traffic and having a utility device located therebelow;

(b) said roadway being supported by a sub-base;

(c) a block from rubber or similar elastomeric material located in said roadway above said utility device;

(d) said block having a planar upper surface which is coplanar with said roadway surface;

(e) said block having a transverse passageway defined therein that bisects said upper surface and exposes said utility device;

(f) a plug which seals said passageway, said plug having a top which is coplanar with said upper surface when said plug is in place in said passageway; wherein (g) said block is supported by said subsurface without any intervention by said utility device, and said plug is supported entirely by said block.

6. A utility device access opening in a roadway comprising:

(a) a roadway having an upper surface for supporting vehicular traffic and having a utility device located therebelow;

(b) said roadway being supported by a sub-base;

(c) a block from rubber or similar elastomeric material located in said roadway above said utility device;

(d) said block having a planar upper surface which is coplanar with said roadway surface;

(e) said block having a transverse passageway defined therein that bisects said upper surface and exposes said utility device;

(f) a plug which seals said passageway, said plug having a top which is coplanar with said upper surface when said plug is in place in said passageway; wherein (g) no portion of said roadway vertically overlies any portion of said block.

* * * * *

UNITED STATES PATENT AND TRADEMARK OFFICE

CERTIFICATE OF CORRECTION

PATENT NO. : 5,030,030

DATED : July 9, 1991

INVENTOR(S) : Larry V. Simmonds

It is certified that error appears in the above-identified patent and that said Letters Patent is hereby corrected as shown below:

In the Abstract:

| | |
|---|---|
| Line 8 | Change "or" to --of-- |
| Col. 3, line 8 | Change "counterbore 1" to --counterbore 18-- |
| Col. 4, line 43 | After "equal to at least" insert --40%-- |

Signed and Sealed this

Twenty-third Day of March, 1993

*Attest:*

STEPHEN G. KUNIN

*Attesting Officer*

*Acting Commissioner of Patents and Trademarks*